US008415078B2

(12) United States Patent
Tanaka et al.

(10) Patent No.: US 8,415,078 B2
(45) Date of Patent: Apr. 9, 2013

(54) ELECTROPHOTOGRAPHIC PHOTOSENSITIVE MEMBER, PROCESS ELECTROPHOTOGRAPHIC APPARATUS

(75) Inventors: Masato Tanaka, Tagata-gun (JP); Masaki Nonaka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 13/153,318

(22) Filed: Jun. 3, 2011

(65) Prior Publication Data

US 2012/0003576 A1 Jan. 5, 2012

(30) Foreign Application Priority Data

Jun. 30, 2010 (JP) ..... 2010-149566
May 25, 2011 (JP) ..... 2011-116547

(51) Int. Cl.
*G03G 5/047* (2006.01)

(52) U.S. Cl. ..... 430/59.1; 430/59.4; 399/159

(58) Field of Classification Search ..... 430/59.1, 430/59.4; 399/159
See application file for complete search history.

(56) References Cited

U.S. PATENT DOCUMENTS 5,194,353 A 3/1993 Tanaka et al.
5,229,238 A 7/1993 Kobayashi et al.
5,246,807 A 9/1993 Kanemaru et al.
5,376,487 A 12/1994 Ueda
5,393,627 A 2/1995 Nakamura et al.
5,422,211 A 6/1995 Law et al.
5,453,342 A 9/1995 Go et al.
5,464,718 A 11/1995 Kashizaki et al.
5,527,653 A 6/1996 Tanaka
5,629,116 A 5/1997 Kashizaki et al.
5,666,589 A 9/1997 Yoshinaga et al.
5,811,212 A 9/1998 Tanaka
5,818,489 A 10/1998 Yoshinaga et al.
6,040,100 A 3/2000 Tanaka et al.
6,139,997 A 10/2000 Tanaka et al.
6,183,922 B1 2/2001 Takai et al.
6,190,811 B1 2/2001 Tanaka et al.
6,218,063 B1 4/2001 Tanaka et al.
6,245,472 B1 6/2001 Tanaka
6,248,490 B1 6/2001 Suzuki et al.
6,270,936 B1 8/2001 Tanaka et al.
6,335,132 B1 1/2002 Tanaka et al.

(Continued)

FOREIGN PATENT DOCUMENTS

CN 101025587 A 8/2007
CN 101086632 A 12/2007

(Continued)

OTHER PUBLICATIONS

Search Report dated Sep. 29, 2011 in European Application No. 11004620.8.

(Continued)

*Primary Examiner* — Peter Vajda
(74) *Attorney, Agent, or Firm* — Fitzpatrick, Cella, Harper & Scinto

(57) ABSTRACT

The charge generation layer of an electrophotographic photosensitive member is made to contain a specific amine compound in order to provide an electrophotographic photosensitive member that can output images that are practically free from an image flaw or have less image flaws attributable to a ghost phenomenon under low temperature and low humidity environment and a process cartridge and an electrophotographic apparatus having the electrophotographic photosensitive member.

17 Claims, 1 Drawing Sheet

U.S. PATENT DOCUMENTS

| | | | | |
|---|---|---|---|---|
| 6,472,524 | B2 | 10/2002 | Tanaka | |
| 6,683,175 | B2 | 1/2004 | Tanaka | |
| 6,773,856 | B2 | 8/2004 | Tanaka et al. | |
| 6,833,227 | B2 | 12/2004 | Tanaka | |
| 7,245,851 | B2 | 7/2007 | Fujii et al. | |
| 7,276,318 | B2 | 10/2007 | Fujii et al. | |
| 7,333,752 | B2 | 2/2008 | Kawahara et al. | |
| 7,517,626 | B2 | 4/2009 | Fujii et al. | |
| 7,524,598 | B2 | 4/2009 | Iwanaga et al. | |
| 7,727,692 | B2 | 6/2010 | Yamada et al. | |
| 7,796,934 | B2 | 9/2010 | Teshigawara | |
| 7,910,274 | B2 | 3/2011 | Tanaka et al. | |
| 8,088,541 | B2 | 1/2012 | Tanaka et al. | |
| 2006/0292469 | A1* | 12/2006 | Nagasaka et al. | 430/59.4 |
| 2009/0061340 | A1* | 3/2009 | Lin et al. | 430/58.8 |
| 2010/0062171 | A1 | 3/2010 | Kaku et al. | |
| 2011/0045390 | A1 | 2/2011 | Tanaka | |
| 2011/0293323 | A1 | 12/2011 | Tanaka et al. | |
| 2012/0033994 | A1 | 2/2012 | Tanaka et al. | |

FOREIGN PATENT DOCUMENTS

| | | | |
|---|---|---|---|
| CN | 101101459 | A | 1/2008 |
| EP | 1 542 081 | A1 | 6/2005 |
| JP | 52-23351 | A | 2/1977 |
| JP | 60-237453 | A | 11/1985 |
| JP | 63-159860 | A | 7/1988 |
| JP | 2-298951 | A | 12/1990 |
| JP | 5-142813 | A | 6/1993 |
| JP | 6-273953 | A | 9/1994 |

OTHER PUBLICATIONS

Chinese Office Action dated Jun. 19, 2012 in Chinese Application No. 201110184493.5.

* cited by examiner

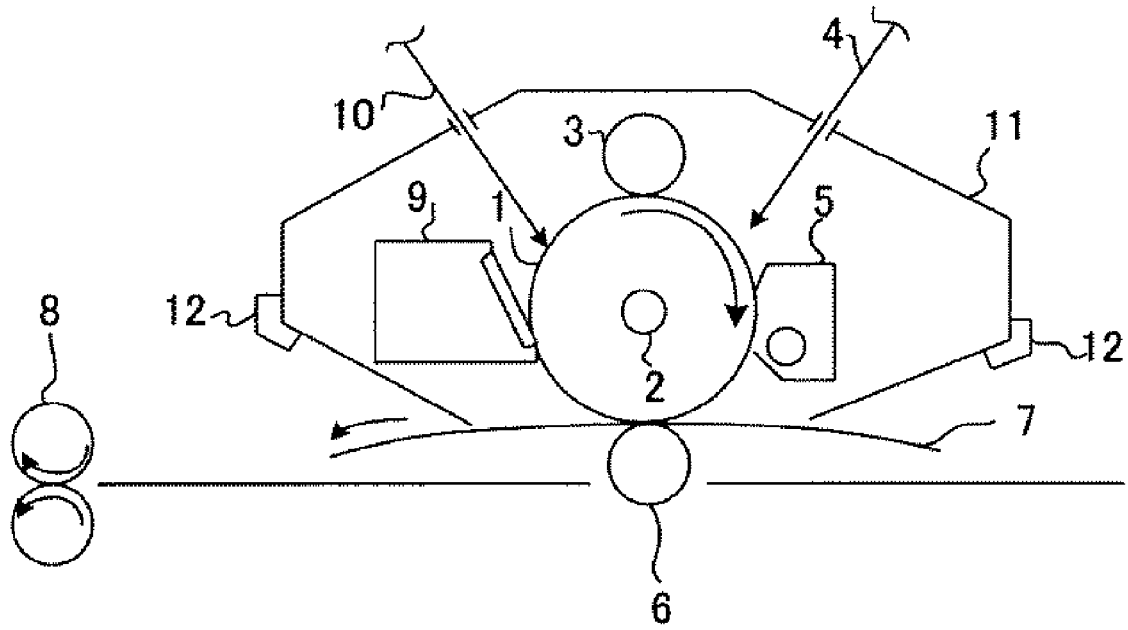
4
10
3
11
9
1
5
8
12
12
2
7
6

ELECTROPHOTOGRAPHIC PHOTOSENSITIVE MEMBER, PROCESS ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus having the electrophotographic photosensitive member.

2. Description of the Related Art

The oscillation wavelengths of semiconductor lasers that are currently being employed as image exposing units are relatively long and between 650 nm and 820 nm, and hence efforts are being made to develop electrophotographic photosensitive members that are highly sensitive to light of such long wavelengths. Furthermore, in terms of high resolution, efforts are also being made to develop electrophotographic photosensitive members that are highly sensitive to light of semiconductor lasers whose oscillation wavelengths are short.

Azo pigments and phthalocyanine pigments are known as charge generation substances representing a high degree of sensitivity relative to light of such a long wavelength region and also to light of a short wavelength region.

Thus, an electrophotographic photosensitive member formed by using an azo pigment or a phthalocyanine pigment has excellent sensitivity characteristics. On the other hand, however, the photo carriers generated by such an electrophotographic photosensitive member are apt to remain in a photosensitive layer and give rise to a problem of generating potential fluctuations such as a ghost phenomenon because the member operates as a type of memory.

Japanese Patent Applications Laid-Open Nos. H02-298951, H06-273953 and H05-142813 disclose the use of a benzophenone compound for electrophotographic photosensitive members. The advantages of using a benzophenone compound include suppression of degradation of a charge transport substance by ultraviolet rays (Japanese Patent Application Laid-Open No. H02-298951), prevention of photooxidation of a charge generation substance and suppression of a rise of residual potential (Japanese Patent Application Laid-Open No. H06-273953), and sensitization of pyrrolopyrrole compounds (Japanese Patent Application Laid-Open No. H05-142813).

However, none of these patent applications discloses a benzophenone compound having one or more amino groups as substituent.

Japanese Patent Application Laid-Open No. S52-23351 discloses an electrophotographic photosensitive member containing a polymeric compound having a carbazole ring as side chain and a basic compound as principal ingredients, as an example of using a benzophenone compound having one or more amino groups as substituent. The object of the cited invention is to improve the low charge transport ability and provide the electrophotographic photosensitive member with plasticity for improving the poor film forming performance, which are a drawback of polyvinyl carbazole.

Thus, various attempts have been made to date to obtain improved electrophotographic photosensitive members.

However, there has been in recent years and still is a strong demand for improving the problem of degradation of image quality due to a ghost phenomenon that can occur under various environments from the viewpoint of achieving a higher image quality.

SUMMARY OF THE INVENTION

Therefore, an object of the present invention is to solve the above identified problems and provide an electrophotographic photosensitive member capable of outputting images that are practically free from an image flaw or have less image flaws attributable to a ghost phenomenon not only under normal temperature and normal humidity environment but also under low temperature and low humidity harsh environment, and a process cartridge and an electrophotographic apparatus having the electrophotographic photosensitive member.

In an aspect of the present invention, there is provided an electrophotographic photosensitive member comprising a support, and a charge generation layer and a charge transport layer formed on the support, wherein the charge generation layer comprises a charge generation substance and an amine compound represented by the following formula (1):

(1)

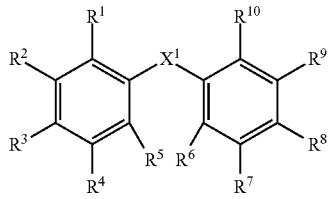

wherein, in the formula (1), each of $R^1$ to $R^{10}$ independently represents a hydrogen atom, a halogen atom, a hydroxy group, a carboxyl group, an alkoxycarbonyl group, an aryloxycarbonyl group, a substituted or non-substituted acyl group, a substituted or non-substituted alkyl group, a substituted or non-substituted alkoxy group, a substituted or non-substituted aryloxy group, a substituted or non-substituted amino group or a substituted or non-substituted cyclic amino group, at least one of $R^1$ to $R^{10}$ representing an amino group substituted by a substituted or non-substituted aryl group, an amino group substituted by a substituted or non-substituted alkyl group or a substituted or non-substituted cyclic amino group, $X^1$ represents a carbonyl group or a dicarbonyl group.

In another aspect of the present invention, there is provided a process cartridge integrally holding the electrophotographic photosensitive member as defined above, and at least one unit selected from the group consisting of a charging unit for electrically charging a surface of the electrophotographic photosensitive member, a developing unit for developing an electrostatic latent image formed on the surface of the electrophotographic photosensitive member by toner to form a toner image, and a cleaning unit for removing the toner on the surface of the electrophotographic photosensitive member after the toner image is transferred onto a transfer material; and the process cartridge being detachably mountable to a main body of an electrophotographic apparatus.

In still another aspect of the present invention, there is provided an electrophotographic apparatus comprising: the electrophotographic photosensitive member as defined above, a charging unit for electrically charging a surface of the electrophotographic photosensitive member, an image exposing unit for irradiating image exposing light to the surface of the electrically charged electrophotographic photosensitive member to form an electrostatic latent image, a developing unit for developing the electrostatic latent image formed on the surface of the electrophotographic photosensitive member by toner to form a toner image, and a transfer unit for transferring the toner image formed on the surface of the electrophotographic photosensitive member onto a transfer material.

Thus, the present invention provides an electrophotographic photosensitive member capable of outputting images that are practically free from an image flaw or have less image flaws attributable to a ghost phenomenon not only under normal temperature and normal humidity environment but also under low temperature and low humidity harsh environment, and a process cartridge and an electrophotographic apparatus having the electrophotographic photosensitive member.

Further features of the present invention will become apparent from the following description of exemplary embodiments with reference to the attached drawing.

BRIEF DESCRIPTION OF THE DRAWINGS

The FIGURE is a schematic illustration of an electrophotographic apparatus including a process cartridge having an electrophotographic photosensitive member according to the present invention, illustrating the configuration thereof.

DESCRIPTION OF THE EMBODIMENTS

Preferred embodiments of the present invention will now be described in detail in accordance with the accompanying drawings.

The amine compound contained in the charge generation layer of an electrophotographic photosensitive member according to the present invention has a structure represented by the following formula (1):

(1)

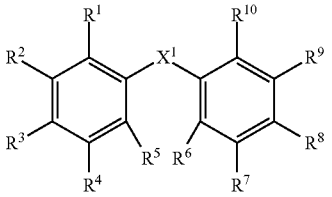

in which formula (1), each of $R^1$ to $R^{10}$ independently represents a hydrogen atom, a halogen atom, a hydroxy group, a carboxyl group, an alkoxycarbonyl group, an aryloxycarbonyl group, a substituted or non-substituted acyl group, a substituted or non-substituted alkyl group, a substituted or non-substituted alkoxy group, a substituted or non-substituted aryloxy group, a substituted or non-substituted amino group or a substituted or non-substituted cyclic amino group, at least one of $R^1$ to $R^{10}$ representing an amino group substituted by a substituted or non-substituted aryl group, an amino group substituted by a substituted or non-substituted alkyl group or a substituted or non-substituted cyclic amino group, $X^1$ represents a carbonyl group or a dicarbonyl group.

Preferably, at least one of $R^1$ to $R^{10}$ in the above formula (1) is the amino group substituted by the substituted or non-substituted alkyl group. Preferably, the substituted or non-substituted alkyl group is an alkyl group substituted by an alkoxy group, an alkyl group substituted by an aryl group or a non-substituted alkyl group.

Preferably, at least one of $R^1$ to $R^{10}$ in the above formula (1) is a dialkylamino group. More preferably, at least one of $R^1$ to $R^{10}$ in the above formula (1) is a dimethylamino group or a diethylamino group.

Preferably, at least one of $R^1$ to $R^{10}$ in the above formula (1) is the substituted or non-substituted cyclic amino group. More preferably, at least one of $R^1$ to $R^{10}$ in the above formula (1) is a morpholyl group or a piperidyl group.

An amine compound represented by the following formula (2) or (3) is particularly preferable from the viewpoint of the effect of suppressing the image flaw due to a ghost phenomenon:

(2)

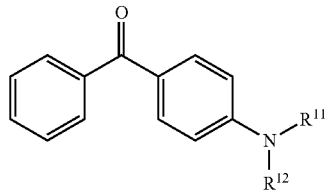

(3)

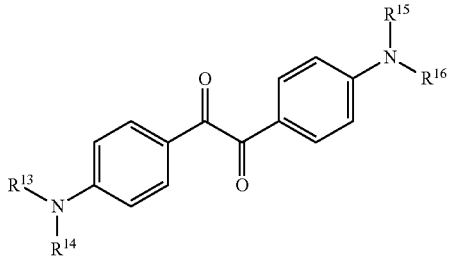

in which formulas (2) and (3), each of $R^{11}$, $R^{13}$ and $R^{15}$ independently represents a hydrogen atom, a substituted or non-substituted alkyl group or a substituted or non-substituted aryl group, and each of $R^{12}$, $R^{14}$ and $R^{16}$ independently represents a substituted or non-substituted alkyl group or a substituted or non-substituted aryl group. Alternatively, $R^{11}$ and $R^{12}$, $R^{13}$ and $R^{14}$, and $R^{15}$ and $R^{16}$ may be bonded to each other to form a substituted or non-substituted cyclic amino group.

Preferably, each of $R^{11}$ to $R^{16}$ in the above formulas (2) and (3) represents an alkyl group substituted by an alkoxy group, an alkyl group substituted by an aryl group or a non-substituted alkyl group. More preferably, each of $R^{11}$ to $R^{16}$ in the above formulas (2) and (3) represents a methyl group or an ethyl group.

Preferably, $R^{11}$ and $R^{12}$, $R^{13}$ and $R^{14}$, and $R^{15}$ and $R^{16}$ in the above formulas (2) and (3) are bonded to each other to form substituted or non-substituted cyclic amino groups. More preferably, they are bonded to form morpholyl groups or piperidyl groups.

The substituent that may be included in each of the substituted or non-substituted acyl group, the substituted or non-substituted alkyl group, the substituted or non-substituted alkoxy group, the substituted or non-substituted aryloxy group, the substituted or non-substituted amino group, the substituted or non-substituted aryl group or the substituted or non-substituted cyclic amino group in the above formulas (1) to (3) is, for example, selected from an alkyl group such as a methyl group, an ethyl group, a propyl group or a butyl group, an alkoxy group such as a methoxy group or an ethoxy group, a dialkylamino group such as a dimethylamino group or a diethylamino group, an alkoxycarbonyl group such as a methoxycarbonyl group or an ethoxycarbonyl group, an aryl group such as a phenyl group, a naphthyl group or a biphenyl group, a halogen atom such as a fluorine atom, a chlorine atom or a bromine atom, a hydroxy group, a nitro group, a cyano group and a halomethyl group. Of the above, an aryl group and an alkoxy group are preferable substituents.

Preferable examples (exemplar compounds) of the amine compound contained in the charge generation layer of an electrophotographic photosensitive member according to the present invention are listed below, although the present invention is by no means limited thereto.

Exemplar compound (1)

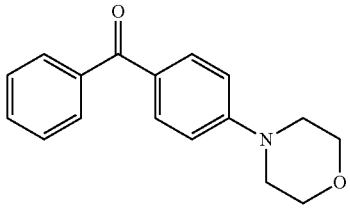

Exemplar compound (2)

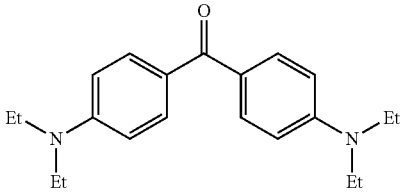

Exemplar compound (3)

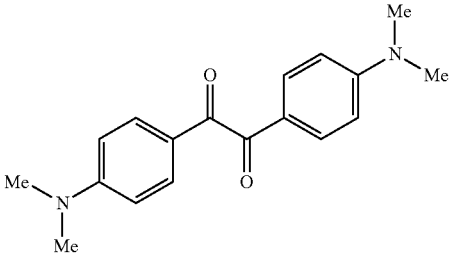

Exemplar compound (4)

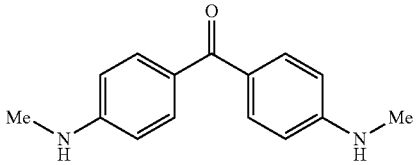

Exemplar compound (5)

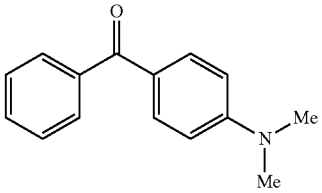

Exemplar compound (6)

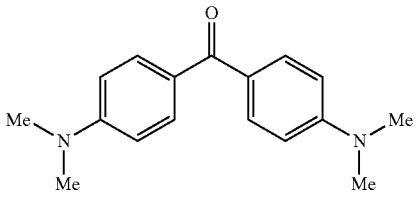

-continued

Exemplar compound (7)

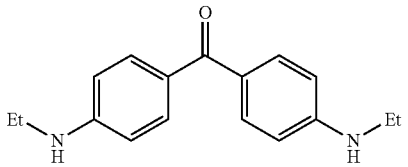

Exemplar compound (8)

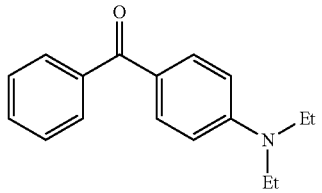

Exemplar compound (9)

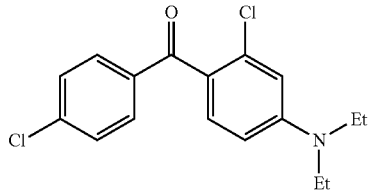

Exemplar compound (10)

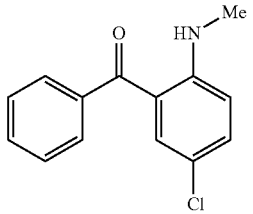

Exemplar compound (11)

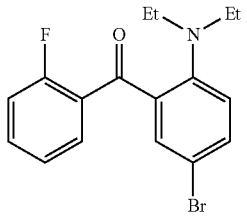

Exemplar compound (12)

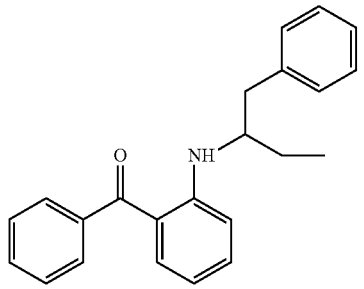

Exemplar compound (13)

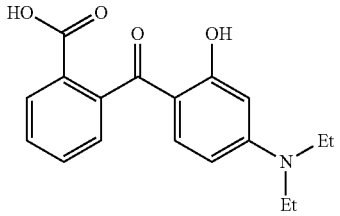

-continued

Exemplar compound (14)

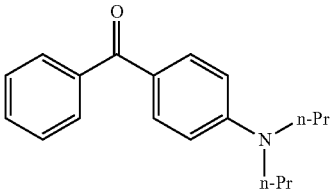

Exemplar compound (15)

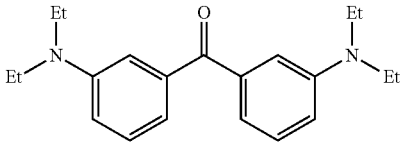

Exemplar compound (16)

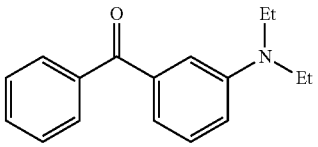

Exemplar compound (17)

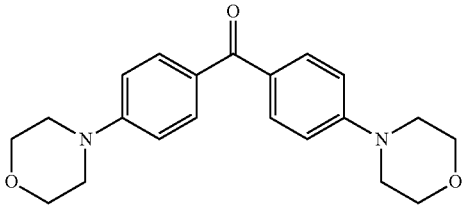

Exemplar compound (18)

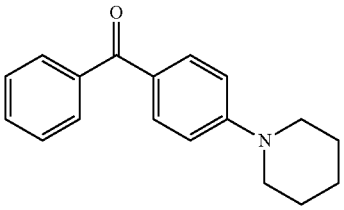

Exemplar compound (19)

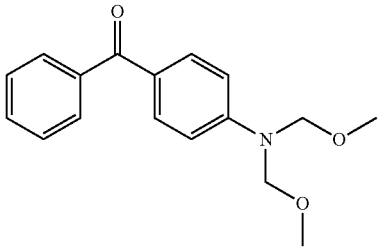

Exemplar compound (20)

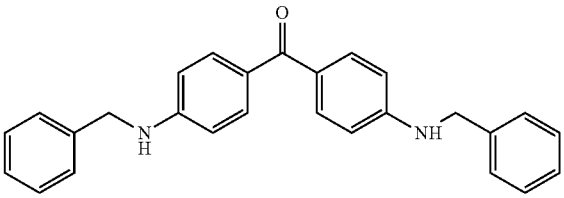

-continued

Exemplar compound (21)

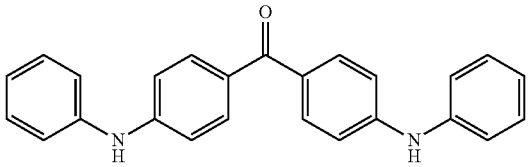

Exemplar compound (22)

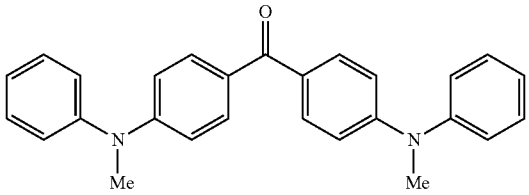

Exemplar compound (23)

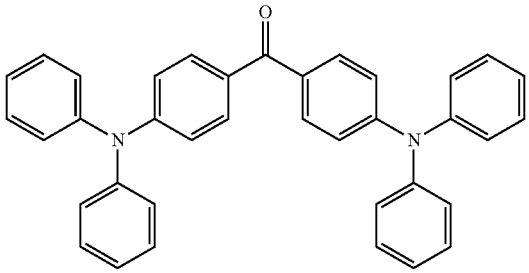

Exemplar compound (24)

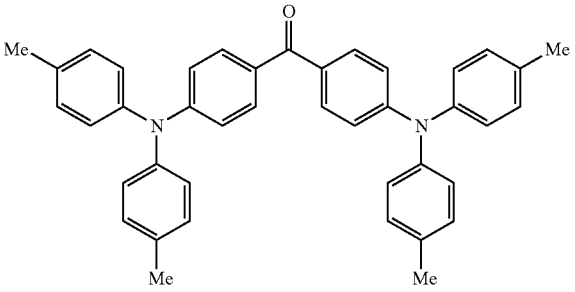

In the above exemplar compounds, Me represents a methyl group and Et represents an ethyl group, while n-Pr represents a propyl group (n-propyl group).

While amine compounds that can be used for the purpose of the present invention are commercially available, they can be synthesized by means of any of the exemplar synthesis methods described below.

A substituent can be introduced into an amino group by way of a substitution reaction of aminobenzophenone and a halide by using aminobenzophenone as a material. In particular, a reaction between aminobenzophenone and an aromatic halogen compound using a metal catalyst is useful for synthesizing an aryl-group-substituted amine compound. A reaction using reductive amination is a useful for synthesizing an alkyl-group-substituted amine compound.

A specific example of synthesizing the exemplar compound (24) will be described below.

In the following description, "portion" refers to "mass portion". IR (infrared) absorption spectrum was observed by means of a Fourier transform infrared spectrophotometer (FT/IR-420: tradename, available from JASCO Corporation). NMR (nuclear magnetic resonance) spectrum was observed by means of a nuclear magnetic resonance apparatus (EX-400: tradename, available from JEOL Corporation).

Exemplar Synthesis

Synthesis of Exemplar Compound (24)

5.0 portions of 4,4'-diaminobenzophenone, 25.7 portions of iodotoluene, 9.0 portions of copper powder and 9.8 portions of potassium carbonate were added to 50 portions of N,N-dimethylacetamide held in a 3-neck flask, and the mixture was refluxed for 20 hours. After the reflux, the solid ingredients were removed by hot filtration. The solvent were distilled away under reduced pressure, and the residue was refined in a silica gel column (solvent:toluene) to obtain 8.1 portions of exemplar compound (24).

The characteristic peaks of the IR absorption spectrum and those of the $^1$H-NMR spectrum obtained by the observations are listed below.

IR ($cm^{-1}$, KBr): 1646, 1594, 1508, 1318, 1277, 1174

$^1$H-NMR (ppm, CDCL3, 40° C.): δ=7.63 (d, 4H), 7.11 (d, 8H), 7.04 (d, 8H), 6.93 (d, 4H), 2.33 (s, 12H)

Phthalocyanine pigments and azo pigments representing a high degree of sensitivity are preferable substances that can be used for the charge generation substance to be contained in the charge generation layer of an electrophotographic photosensitive member according to the present invention. Of such pigments, phthalocyanine pigments are particularly preferable.

Phthalocyanine pigments include metal-free phthalocyanines and metal phthalocyanines, which may have one or more axial ligands and/or substituents. Among phthalocyanine pigments, oxytitaniumphthalocyanines and galliumphthalocyanines are preferable because they represent an excellent sensitivity and hence make the present invention very effective, although they are apt to produce a ghost phenomenon.

Furthermore, among oxytitaniumphthalocyanines and galliumphthalocyanines, hydroxygalliumphthalocyanine crystals of a crystalline form having strong peaks at Bragg angles 2θ of 7.4°±0.3° and 28.2°±0.3° for CuKα X-ray diffraction, chloro gallium phthalocyanine crystals of a crystalline form having strong peaks at Bragg angles 2θ±0.2° of 7.4°, 16.6°, 25.5° and 28.3° for CuKα X-ray diffraction and oxytitaniumphthalocyanine crystals of a crystalline form having a strong peak at Braggs angle 2θ of 27.2°±0.2° for CuKα X-ray diffraction are preferable.

Of the above listed, hydroxygalliumphthalocyanine crystals of a crystalline form having strong peaks at Bragg angles 2θ of 7.4°±0.3° and 28.2°±0.3° is preferable.

Furthermore, among such hydroxygalliumphthalocyanine crystals, those of a crystalline form having strong peaks at Bragg angles 2θ±0.2° of 7.3°, 24.9° and 28.1° having the strongest peak at Bragg angle 2θ±0.2° of 28.1°, and those of a crystalline form having strong peaks at Bragg angles 2θ±0.2° of 7.5°, 9.9°, 16.3°, 18.6°, 25.1° and 28.3° are preferable.

An electrophotographic photosensitive member according to the present invention includes a charge generation layer containing a charge generation substance and a charge transport layer containing a charge transport substance as a photosensitive layer. While either of the charge generation layer and the charge transport layer may be the upper layer (located at the surface side) of the two, the charge generation layer is preferably the lower layer (located at the support side) of the two.

The support preferably has electro-conductivity (electroconductive support). More specifically, the support can be selected from support made of metal such as aluminum or stainless steel, a metal arranged an electroconductive film on the surface, plastic or paper. The profile of the support may be cylindrical or film-shaped.

An undercoat layer (intermediate layer) having a function of operating as barrier and adhesive may be arranged between the support and the photosensitive layer (charge transport layer, charge generation layer).

The undercoat layer can be formed by preparing an application liquid for undercoat layers by dissolving resin such as polyvinyl alcohol, polyethylene oxide, ethyl cellulose, methyl cellulose, casein, polyamide, glue or gelatin into a solvent, applying the application liquid for undercoat layers onto the support or the electroconductive layer, which will be described in greater detail hereinafter, and drying the produced coat film.

Preferably, the undercoat layer has a film thickness between 0.3 and 5.0 μm.

An electroconductive layer may be arranged between the support and the undercoat layer for the purpose of covering the unevenness and the defects, if any, of the surface of the support and suppressing the interference fringes that can appear.

The electroconductive layer can be formed by preparing an application liquid for electroconductive layers by dispersing electroconductive particles such as carbon black, metal particles or metal oxide particles into a solvent with binding resin, applying the application liquid for electroconductive layers onto the support and drying/curing the produced coat film.

The electroconductive layer has a film thickness preferably between 5 and 40 μm, more preferably between 10 and 30 μm.

The charge generation layer can be formed by preparing an application liquid for charge generation layers by dispersing the above-described amine compound and the charge generation substance into a solvent with binding resin, applying the application liquid for charge generation layers and drying the produced coat film.

The charge generation layer has a film thickness preferably between 0.05 and 1 μm, more preferably between 0.1 and 0.3 μm.

The content ratio of the above-described amine compound in the charge generation layer is preferably not less than 0.05 mass % and not more than 15 mass %, more preferably not less than 0.1 mass % and not more than 10 mass %, relative to the total mass of the charge generation layer. Additionally, the content ratio of the above-described amine compound in the charge generation layer is preferably not less than 0.1 mass % and not more than 20 mass %, more preferably not less than 0.3 mass % and not more than 10 mass %, relative to the charge generation substance.

The content ratio of the charge generation substance in the charge generation layer is preferably not less than 30 mass % and not more than 90 mass %, more preferably not less than 50 mass % and not more than 80 mass %, relative to the total mass of the charge generation layer.

The above-described amine compound contained in the charge generation layer may be amorphous or crystalline. Two or more amine compounds may be used in combination for the purpose of the present invention.

The binding resin to be used for the charge generation layer can be selected from polyester, acrylic resin, phenoxy resin, polycarbonate, polyvinyl butyral, polystyrene, polyvinyl acetate, polysulfone, polyarylate, vinylidene chloride, acrylonitrile copolymers, polyvinyl benzal and so on, of which polyvinyl butyral and polyvinyl benzal are preferable.

The charge transport layer can be formed by preparing an application liquid for charge transport layers by dissolving a charge transport substance and binding resin into a solvent, applying the application liquid for charge transport layers and drying the produced coat film.

The charge transport layer has a thickness preferably between 5 and 40 μm, more preferably between 10 and 25 μm.

The content ratio of the charge transport substance is preferably not less than 20 mass % and not more than 80 mass %, more preferably not less than 30 mass % and not more than 60 mass %, relative to the total mass of the charge transport layer.

The charge transport substance can be selected from triarylamine compounds, hydrazone compounds, stilbene compounds, pyrazoline compounds, oxazole compounds, thiazole compounds, triarylmethane compounds and so on, of which triarylamine compounds are preferable.

The binding resin to be used for the charge transport layer can be selected from resin such as polyester, acrylic resin, phenoxy resin, polycarbonate, polystyrene, polyvinyl acetate, polysulfone, polyarylate, vinylidene chloride, acrylonitrile copolymers and so on, of which polycarbonate and polyarylate are preferable.

The application techniques that can be used for application of the application liquids of the layers include dip coating (dipping), spray coating, spinner coating, bead coating, blade coating and beam coating.

A protective layer may be arranged on the photosensitive layer (charge generation layer, charge transport layer) for the purpose of protecting the photosensitive layer.

The protective layer can be formed by preparing an application liquid for protective layers by dissolving resin selected from polyvinyl butyral, polyester, polycarbonates (polycarbonate Z and modified polycarbonates), nylon, polyimide, polyarylate, polyurethane, styrene-butadiene copolymers, styrene-acrylic acid copolymers, styrene-acrylonitrile copolymers into a solvent, applying the prepared application liquid onto the photosensitive layer and drying/curing the produced coat film. When the coat film is cured, the coat film can be cured by means of heating, electron rays or ultraviolet rays.

Preferably, the protective layer has a film thickness between 0.05 and 20 μm.

The protective layer may be made to contain electroconductive particles, an ultraviolet absorbing agent and lubricating particles such as fluorine atom-containing resin particles. Electroconductive particles that can be used for the purpose of the present invention include metal oxide particles such as tin oxide particles.

The FIGURE is a schematic illustration of an electrophotographic apparatus including a process cartridge having an electrophotographic photosensitive member according to the present invention, representing an exemplar configuration thereof.

In the FIGURE, 1 denotes the cylindrical (drum-shaped) electrophotographic photosensitive member that is adapted to be driven to rotate around axis 2 in the direction indicated by an arrow at a predetermined peripheral speed (process speed).

The surface of the electrophotographic photosensitive member 1 is electrically charged to a predetermined positive or negative electric potential level by charging unit 3, in rotating process of the electrophotographic photosensitive member 1. Then, the surface of the electrophotographic photosensitive member 1 is irradiated with image exposing light 4 from an image exposing unit (not illustrated) to form an electrostatic latent image that corresponds to the image information for achieving the object of operation. Image exposing light 4 is light whose intensity is modulated according to the time series electric digital image signal of the image information for achieving the object of operation. The image exposing light 4 is typically output from an image exposing unit adapted to output exposing light from a slit or output a scanning laser beam as exposing light.

The electrostatic latent image formed on the surface of the electrophotographic photosensitive member 1 is developed by toner contained in developing unit 5 (normal development or reverse development) so that a toner image is formed on the surface of the electrophotographic photosensitive member 1. The toner image formed on the surface of the electrophotographic photosensitive member 1 is then transferred onto a transfer material 7 by transferring unit 6. At this time, a bias voltage representing a polarity that is reversed relative to that of the electric charge held by the toner is applied to the transferring unit 6 from a bias voltage source (not illustrated). When the transfer material 7 is paper, the transfer material 7 is taken out from a sheet feeding unit (not illustrated) and fed to between the electrophotographic photosensitive member 1 and the transferring unit 6 in synchronism with the rotation of the electrophotographic photosensitive member 1.

The transfer material 7 onto which the toner image is transferred from the electrophotographic photosensitive member 1 is separated from the surface of the electrophotographic photosensitive member 1 and conveyed to image fixing unit 8, where the toner image is subjected to a fixing process so that a fixed image is printed on the transfer material and sent out from the electrophotographic apparatus as image forming material (print, copy).

After the toner image is transferred onto the transfer material 7, the toner (the residual toner that is left after the transfer of a toner image) and other substances, if any, adhering to the surface of the electrophotographic photosensitive member 1 are removed from the surface by cleaning unit 9 and then the surface is cleaned. Cleanerless systems have been developed in recent years and the residual toner that is left after the transfer of a toner image can be directly removed by means of a developing unit. Additionally, the surface of the electrophotographic photosensitive member 1 is subjected to a neutralization process by means of pre-exposing light 10 from a pre-exposing unit (not illustrated) so as to be employed repeatedly for image forming operations. The pre-exposing unit is not necessarily required when the charging unit 3 is a contact charging unit using a charging roller.

For the purpose of the present invention, a process cartridge can be formed by containing a plurality of components selected from the above-described components including an electrophotographic photosensitive member 1, a charging unit 3, a developing unit 5 and a cleaning unit 9 in a container, which is adapted to integrally support them, so as to be removably mounted on an electrophotographic apparatus main body. For example, at least one of a charging unit 3, a developing unit 5 or a cleaning unit 9 may be put into a cartridge with an electrophotographic photosensitive member 1, which integrally supports them, so as to form a process cartridge 11 that is adapted to be removably mounted on an electrophotographic apparatus main body by means of a guide unit 12 such as a rail belonging to the electrophotographic apparatus main body.

When the electrophotographic apparatus is a copying machine or a printer, image exposing light 4 may be light reflected by or transmitted through a manuscript. Alternatively, the image exposing light 4 may be light radiated as a result of an operation of; reading a manuscript by means of a sensor; signalizing the read out data; and scanning a laser beam, driving an LED array or a liquid crystal shutter array, according to the obtained signal.

An electrophotographic photosensitive member 1 according to the present invention can be applicable for a broad scope of applications for electrophotography including laser beam printers, CRT printers, LED printers, FAX machines, liquid crystal printers and laser plate making.

Now, the present invention will be described in greater detail by way of specific examples. However, note that the present invention is by no means limited thereto. The film thicknesses in Examples and Comparative Examples were determined by means of an eddy current type film thickness meter (Fischerscope: tradename, available from Fischer Instruments) or by specific gravity conversion using the mass per unit area.

EXAMPLE 1

50 portions of titanium oxide particles coated with tin oxide containing antimony oxide by 10 mass %, 25 portions of resol-type phenol resin, 20 portions of methyl cellosolve, 5 portions of methanol and 0.002 portions of silicon oil (a polydimethylsiloxane-polyoxyalkylene copolymer, average molecular weight: 3,000) were put into a sand mill using glass beads having a diameter of 1 mm and subjected to a dispersion process for 2 hours to prepare an application liquid for electroconductive layers.

The application liquid for an electroconductive layer was applied for dip-coating onto an aluminum cylinder (diameter: 30 mm×length: 260.5 mm) designed to operate as support, and the obtained film coat was dried at 140° C. for 30 minutes to form an electroconductive layer having a film thickness of 20 μm.

Then, 5 portions of 6-66-610-12 quaternary polyamide copolymer was dissolved into a mixture solvent containing 70 portions of methanol and 25 portions of butanol to prepare an application liquid for undercoat layers.

The application liquid for undercoat layers was applied for dip-coating onto the electroconductive layer, and the obtained film coat was dried to form an undercoat layer having a film thickness of 1 μm.

Thereafter, 10 portions of hydroxygalliumphthalocyanine crystal (charge generation substance) of a crystalline form having strong peaks at Bragg angles 2θ±0.2° of 7.5°, 9.9°, 16.3°, 18.6°, 25.1° and 28.3° for CuKα X-ray diffraction, 0.2 portions of the exemplar compound (1) (product code; 159400050, available from Acros Organics Co., Ltd.), 5 portions of polyvinyl butyral (Esrec BX-1: tradename, available from Sekisui Kagaku KK) and 250 portions of cyclohexanone were put into a sand mill using glass beads having a diameter of 1 mm and subjected to a dispersion process of 1 hour. The dispersion product was then diluted by adding 250 portions of ethyl acetate to prepare an application liquid for charge generation layers.

The application liquid for charge generation layers was applied onto the undercoat layer for dip-coating, and the obtained film coat was dried at 100° C. for 10 minutes to form a charge generation layer having a film thickness of 0.16 μm.

Subsequently, 10 portions of compound (charge transfer substance) represented by the following formula (4) and 10 portions of polycarbonate (Iupilon Z-200: tradename, available from Mitsubishi Gas Chemical Company Inc) were dissolved into 70 portions of monochlorobenzene to prepare an application liquid for charge transport layers.

(4)

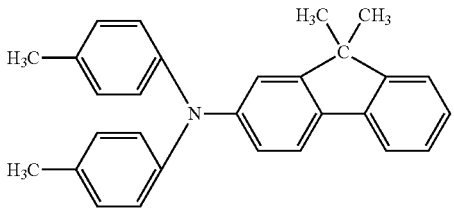

The application liquid for charge transport layers was applied onto the charge generation layer for dip-coating, and the obtained film coat was dried at 110° C. for 1 hour to form a charge transport layer having a film thickness of 25 μm.

In this way, the cylindrical (drum-shaped) electrophotographic photosensitive member of Example 1 was prepared.

EXAMPLE 2

The electrophotographic photosensitive member of Example 2 was prepared as in Example 1 except that 0.2 portions of the exemplar compound (1) of Example 1 was altered to 0.1 portions in this example to prepare an application liquid for charge generation layers.

EXAMPLE 3

The electrophotographic photosensitive member of Example 3 was prepared as in Example 1 except that 0.2 portions of the exemplar compound (1) of Example 1 was altered to 1.0 portions in this example to prepare an application liquid for charge generation layers.

EXAMPLE 4

The electrophotographic photosensitive member of Example 4 was prepared as in Example 1 except that 0.2 portions of the exemplar compound (1) of Example 1 was altered to 0.2 portions of the exemplar compound (2) (product code: B1275, available from Tokyo Chemical Industry Co., Ltd.) in this example to prepare an application liquid for charge generation layers.

EXAMPLE 5

The electrophotographic photosensitive member of Example 5 was prepared as in Example 4 except that 0.2 portions of the exemplar compound (2) of Example 4 was altered to 0.1 portions in this example to prepare an application liquid for charge generation layers.

EXAMPLE 6

The electrophotographic photosensitive member of Example 6 was prepared as in Example 4 except that 0.2 portions of the exemplar compound (2) of Example 4 was altered to 0.03 portions in this example to prepare an application liquid for charge generation layers.

EXAMPLE 7

The electrophotographic photosensitive member of Example 7 was prepared as in Example 1 except that 0.2 portions of the exemplar compound (1) of Example 1 was altered to 0.2 portions of the exemplar compound (3) (product code: B1212, available from Tokyo Chemical Industry Co., Ltd.) in this example to prepare an application liquid for charge generation layers.

EXAMPLE 8

The electrophotographic photosensitive member of Example 8 was prepared as in Example 1 except that 0.2 portions of the exemplar compound (1) of Example 1 was altered to 0.2 portions of the exemplar compound (4) (product code: B1433, available from Tokyo Chemical Industry Co., Ltd.) in this example to prepare an application liquid for charge generation layers.

EXAMPLE 9

The electrophotographic photosensitive member of Example 9 was prepared as in Example 1 except that 0.2 portions of the exemplar compound (1) of Example 1 was altered to 0.2 portions of the exemplar compound (5) (product code: D2561, available from Tokyo Chemical Industry Co., Ltd.) in this example to prepare an application liquid for charge generation layers.

EXAMPLE 10

The electrophotographic photosensitive member of Example 10 was prepared as in Example 1 except that 0.2 portions of the exemplar compound (1) of Example 1 was altered to 0.2 portions of the exemplar compound (24) obtained in the above-described exemplar synthesis in this example to prepare an application liquid for charge generation layers.

EXAMPLE 11

An electroconductive layer, an undercoat layer and a charge generation layer were formed on a support as in Example 1.

Then, 10 portions of the compound (charge transport substance) represented by the following formula (5) and 10 portions of polycarbonate (Iupilon Z-400: tradename, available from Mitsubishi Gas Chemical Company Inc) were dissolved into 100 portions of monochlorobenzene to prepare an application liquid for charge transport layers.

(5)

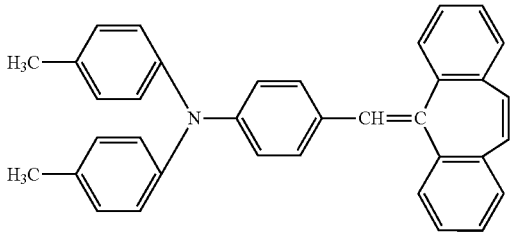

The application liquid for charge transport layers was applied for dip-coating onto the charge generation layer, and the obtained film coat was dried at 150° C. for 30 minutes to form a charge transport layer having a film thickness of 15 μm.

In this way, the electrophotographic photosensitive member was prepared in Example 11.

EXAMPLE 12

The electrophotographic photosensitive member of Example 12 was prepared as in Example 1 except that 10 portions of hydroxygalliumphthalocyanine crystal of a crystalline form having strong peaks at Bragg angles 2θ±0.2° of 7.5°, 9.9°, 16.3°, 18.6°, 25.1° and 28.3° for CuKα X-ray diffraction were altered to 10 portions of oxytitaniumphthalocyanine crystal of a crystalline form having strong peaks at Bragg angles 2θ±0.2° of 9.0°, 14.2°, 23.9° and 27.1° for CuKα X-ray diffraction to prepare an application liquid for charge generation layers.

COMPARATIVE EXAMPLE 1

The electrophotographic photosensitive member of Comparative Example 1 was prepared as in Example 1 except that 0.2 portions of the exemplar compound (1) was not used to prepare an application liquid for charge generation layers.

COMPARATIVE EXAMPLE 2

The electrophotographic photosensitive member of Comparative Example 2 was prepared as in Example 12 except that 0.2 portions of the exemplar compound (1) was not used to prepare an application liquid for charge generation layers.

COMPARATIVE EXAMPLE 3

The electrophotographic photosensitive member of Comparative Example 3 was prepared as in Example 12 except that 0.2 portions of the exemplar compound (1) was altered to 3 portions of the bis azo pigment represented by the following formula (6) to prepare an application liquid for charge generation layers.

(6)

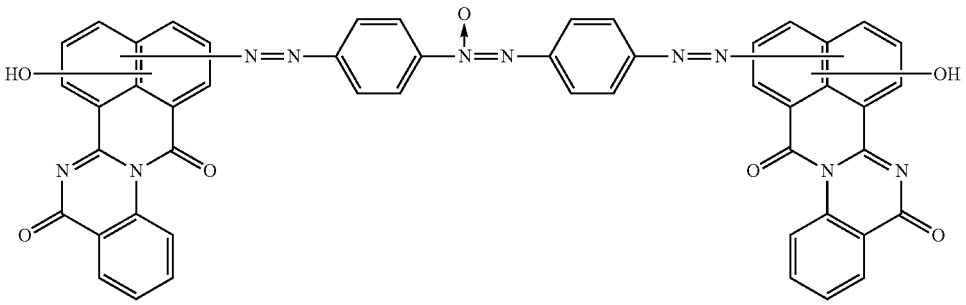

COMPARATIVE EXAMPLE 4

The electrophotographic photosensitive member of Comparative Example 4 was prepared as in Example 1 except that 0.2 portions of the exemplar compound (1) was altered to 0.2 portions of 2,4-dihydroxybenzophenone (product code: 126217, available from Sigma-Aldrich Co., Ltd.) to prepare an application liquid for charge generation layers.

COMPARATIVE EXAMPLE 5

The electrophotographic photosensitive member of Comparative Example 5 was prepared as in Example 1 except that 0.2 portions of the exemplar compound (1) was altered to 0.2 portions of 4,4'-diaminobenzophenone (product code: 378259, available from Sigma-Aldrich Co., Ltd.) to prepare an application liquid for charge generation layers.

COMPARATIVE EXAMPLE 6

The electrophotographic photosensitive member of Comparative Example 6 was prepared as in Example 1 except that 0.2 portions of the exemplar compound (1) was altered to 0.2 portions of 3,3'-dinitrobenzophenone (product code: D1688, available from Tokyo Chemical Industry Co., Ltd.) to prepare an application liquid for charge generation layers.

COMPARATIVE EXAMPLE 7

The electrophotographic photosensitive member of Comparative Example 7 was prepared as in Example 1 except that 0.2 portions of the exemplar compound (1) was altered to 0.2 portions of bis-[4-(dimethylamino)phenyl]methane (product code: B0483, available from Tokyo Chemical Industry Co., Ltd.) to prepare an application liquid for charge generation layers.

COMPARATIVE EXAMPLE 8

The electrophotographic photosensitive member of Comparative Example 8 was prepared as in Example 1 except that 0.2 portions of the exemplar compound (1) was altered to 0.2 portions of benzophenone (product code: B0083, available from Tokyo Chemical Industry Co., Ltd.) to prepare an application liquid for charge generation layers.

Evaluations of Examples 1 to 12 and Comparative EXAMPLES 1 to 8

The electrophotographic photosensitive members of Examples 1 to 12 and Comparative Examples 1 to 8 were measured for the electric potential of bright area and evaluated for ghost images.

A reverse development type laser beam printer (Laser Jet 4000: tradename, available from Hewlett Packard) was employed as electrophotographic apparatus for evaluations.

Firstly, the sample electrophotographic photosensitive members were measured for the electric potential of bright area and evaluated for ghost images under normal temperature and normal humidity environment of 23° C./55% RH as initial measurement and initial evaluation. Subsequently, they were tested for paper-feed durability, using 1,000 sheets of paper for each, under the same normal temperature and normal humidity environment, and then they were measured for the electric potential of bright area and evaluated for ghost images immediately after the durability test and 15 hours after the durability test. The evaluation results under the normal temperature and normal humidity environment are summarily represented in Table 1.

Thereafter, the electrophotographic photosensitive members were left under low temperature and low humidity environment of 15° C./10% RH with the electrophotographic apparatus for evaluations for three days, and then they were measured for the electric potential of bright area and evaluated for ghost images as initial measurement and initial evaluation. Subsequently, they were tested for paper-feed durability, using 1,000 sheets of paper for each, under the same environment, and then they were measured for the electric potential of bright area and evaluated for ghost images immediately after the durability test and 15 hours after the durability test. The evaluation results under the low temperature and low humidity environment are summarily represented in Table 2.

In the test for paper-feed durability, 0.5 mm-width vertical lines were printed at regular intervals of 10 mm on each sheet in an intermittent mode of printing at a rate of four sheets per minute.

A method of the evaluation for ghost images as described below was employed.

A pattern of 5 mm black squares was printed to represent a number of squares equivalent to a full turn of the cylindrical electrophotographic photosensitive members for evaluations, and subsequently an all halftone image (an image of dots with a dot density of 1 dot and 1 space) and an all white image were printed.

A sampling operation for ghost image evaluation was conducted in F5 (central value of density) mode and also in F9 (low density) mode (the mode where ghosts can easily be viewed) for the volume of development of the electrophotographic apparatus for evaluations. The evaluations were given visually and each of the samples were rated by using the ranks (ghost ranks) listed below.

rank 1: No ghost is visible in any mode.

rank 2: A ghost is slightly visible in either of the modes.

rank 3: A ghost is slightly visible in each of the modes.

rank 4: A ghost is visible in each of the modes.

rank 5: A ghost is clearly visible in each of the modes.

Note that a sample of any of the ranks 3, 4 and 5 was determined to be not providing the advantages of the present invention.

TABLE 1

Under normal temperature and normal humidity environment

| | Initial | | Immediately after durability test | | 15 hours after durability test | |
|---|---|---|---|---|---|---|
| | Electric potential of bright area (−V) | Ghost rank | Electric potential of bright area (−V) | Ghost rank | Electric potential of bright area (−V) | Ghost rank |
| Example 1 | 110 | 1 | 105 | 1 | 110 | 1 |
| Example 2 | 110 | 1 | 100 | 1 | 105 | 1 |
| Example 3 | 115 | 1 | 115 | 1 | 115 | 1 |
| Example 4 | 90 | 1 | 85 | 2 | 90 | 1 |
| Example 5 | 100 | 1 | 95 | 2 | 95 | 1 |
| Example 6 | 110 | 1 | 100 | 2 | 105 | 2 |
| Example 7 | 110 | 1 | 105 | 1 | 110 | 1 |
| Example 8 | 100 | 1 | 90 | 2 | 95 | 1 |
| Example 9 | 110 | 1 | 105 | 1 | 105 | 1 |
| Example 10 | 120 | 1 | 110 | 2 | 115 | 2 |
| Example 11 | 125 | 1 | 120 | 1 | 125 | 1 |
| Example 12 | 150 | 1 | 140 | 2 | 145 | 1 |

TABLE 1-continued

| Under normal temperature and normal humidity environment | | | | | | |
|---|---|---|---|---|---|---|
| | Initial | | Immediately after durability test | | 15 hours after durability test | |
| | Electric potential of bright area (−V) | Ghost rank | Electric potential of bright area (−V) | Ghost rank | Electric potential of bright area (−V) | Ghost rank |
| Comp Ex. 1 | 110 | 3 | 95 | 4 | 95 | 3 |
| Comp Ex. 2 | 155 | 2 | 135 | 4 | 140 | 3 |
| Comp Ex. 3 | 165 | 2 | 170 | 4 | 165 | 3 |
| Comp Ex. 4 | 110 | 3 | 85 | 4 | 90 | 3 |
| Comp Ex. 5 | 130 | 3 | 135 | 4 | 130 | 3 |
| Comp Ex. 6 | 90 | 4 | 85 | 5 | 85 | 4 |
| Comp Ex. 7 | 115 | 3 | 100 | 4 | 100 | 3 |
| Comp Ex. 8 | 110 | 3 | 95 | 4 | 95 | 3 |

TABLE 2

| Under low temperature and low humidity environment | | | | | | |
|---|---|---|---|---|---|---|
| | Initial | | Immediately after durability test | | 15 hours after durability test | |
| | Electric potential of bright area (−V) | Ghost rank | Electric potential of bright area (−V) | Ghost rank | Electric potential of bright area (−V) | Ghost rank |
| Example 1 | 120 | 1 | 110 | 1 | 120 | 1 |
| Example 2 | 120 | 1 | 120 | 1 | 120 | 1 |
| Example 3 | 125 | 1 | 125 | 1 | 125 | 1 |
| Example 4 | 100 | 1 | 95 | 2 | 95 | 2 |
| Example 5 | 110 | 1 | 105 | 2 | 105 | 2 |
| Example 6 | 120 | 1 | 120 | 2 | 120 | 2 |
| Example 7 | 120 | 1 | 120 | 2 | 120 | 1 |
| Example 8 | 110 | 1 | 110 | 2 | 110 | 2 |
| Example 9 | 120 | 1 | 120 | 1 | 120 | 1 |
| Example 10 | 130 | 1 | 130 | 2 | 130 | 2 |
| Example 11 | 135 | 1 | 125 | 2 | 135 | 1 |
| Example 12 | 170 | 1 | 160 | 2 | 165 | 2 |
| Comp Ex. 1 | 120 | 4 | 120 | 5 | 120 | 4 |
| Comp Ex. 2 | 180 | 4 | 170 | 5 | 175 | 4 |
| Comp Ex. 3 | 185 | 4 | 190 | 5 | 190 | 4 |
| Comp Ex. 4 | 110 | 3 | 135 | 5 | 115 | 4 |
| Comp Ex. 5 | 140 | 4 | 165 | 5 | 145 | 4 |
| Comp Ex. 6 | 105 | 5 | 130 | 5 | 110 | 5 |
| Comp Ex. 7 | 125 | 4 | 145 | 5 | 125 | 4 |
| Comp Ex. 8 | 120 | 3 | 140 | 4 | 120 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-149566, filed Jun. 30, 2010, and Japanese Patent Application No. 2011-116547, filed May 25, 2011, which are hereby incorporated by reference herein in their entirety.

What is claimed is:

1. An electrophotographic photosensitive member comprising a support, and a charge generation layer and a charge transport layer formed on the support, wherein the charge generation layer comprises a charge generation substance and an amine compound represented by the following formula (1):

(1)

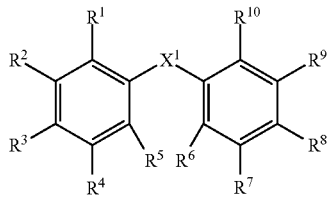

wherein, in the formula (1), each of $R^1$ to $R^{10}$ independently represents a hydrogen atom, a halogen atom, a hydroxy group, a carboxyl group, an alkoxycarbonyl group, an aryloxycarbonyl group, a substituted or non-substituted acyl group, a substituted or non-substituted alkyl group, a substituted or non-substituted alkoxy group, a substituted or non-substituted aryloxy group, a substituted or non-substituted amino group or a substituted or non-substituted cyclic amino group, at least one of $R^1$ to $R^{10}$ representing an amino group substituted by a substituted or non-substituted aryl group, an amino group substituted by a substituted or non-substituted alkyl group or a substituted or non-substituted cyclic amino group, $X^1$ represents a carbonyl group or a dicarbonyl group.

2. The electrophotographic photosensitive member according to claim 1, wherein at least one of the $R^1$ to $R^{10}$ represents the amino group substituted by the substituted or non-substituted alkyl group.

3. The electrophotographic photosensitive member according to claim 2, wherein the substituted or non-substituted alkyl group of the amino group substituted by the substituted or non-substituted alkyl group is an alkyl group substituted by an alkoxy group, an alkyl group substituted by an aryl group or a non-substituted alkyl group.

4. The electrophotographic photosensitive member according to claim 2, wherein the amino group substituted by the substituted or non-substituted alkyl group is a dialkylamino group.

5. The electrophotographic photosensitive member according to claim 4, wherein the dialkylamino group is a dimethylamino group or a diethylamino group.

6. The electrophotographic photosensitive member according to claim 1, wherein at least one of the $R^1$ to $R^{10}$ represents the substituted or non-substituted cyclic amino group.

7. The electrophotographic photosensitive member according to claim 6, wherein the substituted or non-substituted cyclic amino group is a morpholyl group or a piperidyl group.

8. The electrophotographic photosensitive member according to claim 1, wherein the amine compound is an amine compound represented by the following formula (2) or (3):

(2)

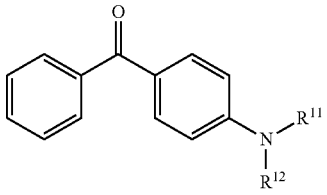

(3)

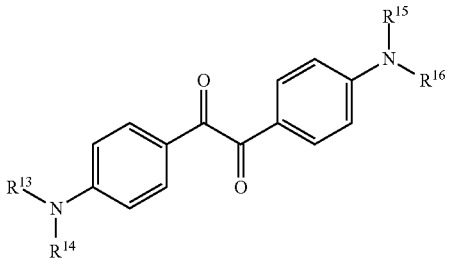

wherein, in the formulas (2) and (3), each of $R^{11}$, $R^{13}$ and $R^{15}$ independently represents a hydrogen atom, a substituted or non-substituted alkyl group or a substituted or non-substituted aryl group, and each of $R^{12}$, $R^{14}$ and $R^{16}$ independently represents a substituted or non-substituted alkyl group or a substituted or non-substituted aryl group, alternatively, $R^{11}$ and $R^{12}$, $R^{13}$ and $R^{14}$, and $R^{15}$ and $R^{16}$ may be bonded to each other to form a substituted or non-substituted cyclic amino group.

9. The electrophotographic photosensitive member according to claim 8, wherein each of the $R^{11}$ to $R^{16}$ represents an alkyl group substituted by an alkoxy group, an alkyl group substituted by an aryl group or a non-substituted alkyl group.

10. The electrophotographic photosensitive member according to claim 8, wherein each of the $R^{11}$ to $R^{16}$ represents a methyl group or an ethyl group.

11. The electrophotographic photosensitive member according to claim 8, wherein the substituted or non-substituted cyclic amino group formed as $R^{11}$ and $R^{12}$, $R^{13}$ and $R^{14}$, and $R^{15}$ and $R^{16}$ are bonded to each other is a morpholyl group or a piperidyl group.

12. The electrophotographic photosensitive member according to claim 1, wherein the charge generation substance is a phthalocyanine pigment.

13. The electrophotographic photosensitive member according to claim 12, wherein the phthalocyanine pigment is galliumphthalocyanine.

14. The electrophotographic photosensitive member according to claim 13, wherein the galliumphthalocyanine is a hydroxygalliumphthalocyanine crystal of a crystalline form having strong peaks at Bragg angles 2θ of 7.4°±0.3° and 28.2°±0.3° for CuKα X-ray diffraction.

15. The electrophotographic photosensitive member according to claim 1, wherein a content ratio of the amine compound in the charge generation layer is not less than 0.1 mass % and not more than 20 mass % relative to the charge generation substance.

16. A process cartridge integrally holding the electrophotographic photosensitive member according to claim 1, and at least one unit selected from the group consisting of a charging unit for electrically charging a surface of the electrophotographic photosensitive member, a developing unit for developing an electrostatic latent image formed on the surface of the electrophotographic photosensitive member by toner to form a toner image, and a cleaning unit for removing the toner on the surface of the electrophotographic photosensitive member after the toner image is transferred onto a transfer material; and the process cartridge being detachably mountable to a main body of an electrophotographic apparatus.

17. An electrophotographic apparatus comprising:

the electrophotographic photosensitive member according to claim 1, a charging unit for electrically charging a surface of the electrophotographic photosensitive member, an image exposing unit for irradiating image exposing light to the surface of the electrically charged electrophotographic photosensitive member to form an electrostatic latent image, a developing unit for developing the electrostatic latent image formed on the surface of the electrophotographic photosensitive member by toner to form a toner image, and a transfer unit for transferring the toner image formed on the surface of the electrophotographic photosensitive member onto a transfer material.

* * * * *